US006150913A

United States Patent [19]

Simmons

[11] Patent Number: 6,150,913

[45] Date of Patent: Nov. 21, 2000

[54] MAGNETICALLY-ACTIVATED SPINNING DISC

[76] Inventor: Donald D. Simmons, 15803 Vista Dr., Dumfries, Va. 22026

[21] Appl. No.: 09/150,566

[22] Filed: Sep. 10, 1998

[51] Int. Cl.[7] ..... H01F 7/02

[52] U.S. Cl. ..... 335/306; 446/132; 273/456

[58] Field of Search ..... 335/296–306; 310/90.5; 446/131–135, 129, 233–235, 256–264; 273/456

[56] References Cited

U.S. PATENT DOCUMENTS 4,828,258 5/1989 Gebert ..... 273/1
5,595,141 1/1997 Udelle et al. ..... 119/706
5,886,608 3/1999 Chabay ..... 335/306

*Primary Examiner*—Michael L. Gellner
*Assistant Examiner*—Raymond Barrera

[57] ABSTRACT

A magnetically activated disc has a flat bipolar ring magnet mounted concentrically on the upper surface of the disc. The bottom surface of the disc has a protruding center point which provides an axis around which the disc can spin. The disc has a sidewall on the upper surface extending upwardly around the circumference of the disc to form an open cavity for holding a removable disc having a design imprinted on its upper surface. An external permanent magnet is manipulated so that its magnetic field acts upon the bipolar ring magnet, thereby causing the disc to spin around the protruding center point so that the disc with the imprinted design produces a desired visual effect.

7 Claims, 2 Drawing Sheets

MAGNETICALLY-ACTIVATED SPINNING DISC

BACKGROUND OF THE INVENTION

This invention relates to a display device comprising a macnetically-activated disc which produces a spinning motion in response to a manually or mechanically operated external magnetic field.

In the past, there have been display devices or toys which utilize magnetic forces to achieve similar results. The following patents from the prior art are illustrative of such devices:

| | |
|---|---|
| 2,774,185 | 12-18-56 Kosch |
| 4,382,245 | 05-03-83 Harrigan |
| 4,404,766 | 09-20-83 Toth |
| 5,007,877 | 04-16-91 Watson |
| 5,347,253 | 09-13-94 Ogikubo |

While these prior art devices illustrate various principles of magnetic fields in their operation, none of them discloses the structure and unique method of operation utilized in the present invention.

SUMMARY OF THE INVENTION

In accordance with the present invention, a magnetically activated disc is provided with a flat bipolar ring magnet mounted concentrically on the top surface of the disc. The bottom surface of the disc has a protruding center point which provides an axis around which the disc can spin when it is placed on a flat surface such as a table top or a hand-held platform. The disc has a sidewall extending around the circumference of the upper surface of the disc forming an open cavity adapted to hold removable discs having various designs imprinted on their upper surfaces.

An external activator magnet is manipulated over the top of the bipolar ring magnet so that its magnetic field acts upon the magnetic field of the bipolar ring magnet, causing thus disc to spin around the protruding center point when it is positioned on a flat surface such as a table top or a hand-held platform. As the disc spins, it produces a desired visual effect that is dependent upon the particular design employed. By way of illustration, spiral designs produce particularly attractive visual effects as they spin rapidly about the center point axis.

An important feature of operation is the manipulation of the external activator magnet to produce spinning motion of the disc. A certain amount of practice and skill is required to activate the disc in its spinning mode, but the results are well worth the effort in learning. An alignment template disc is provided as a learning guide for operation of the activator magnet.

The novel features that are considered to be characteristic of the invention are set forth in particular in the appended claims. However, the invention itself, both as to construction and method of operation, will be understood best from the following description of the preferred mode for carrying out the invention, when read in connection with the accompanying drawings.

BRIEF DESCRIPTION OF THE DRAWINGS

The invention will now be described by way of example and with reference to the accompanying drawings in which.

DESCRIPTION OF THE INVENTION

Figure 1:
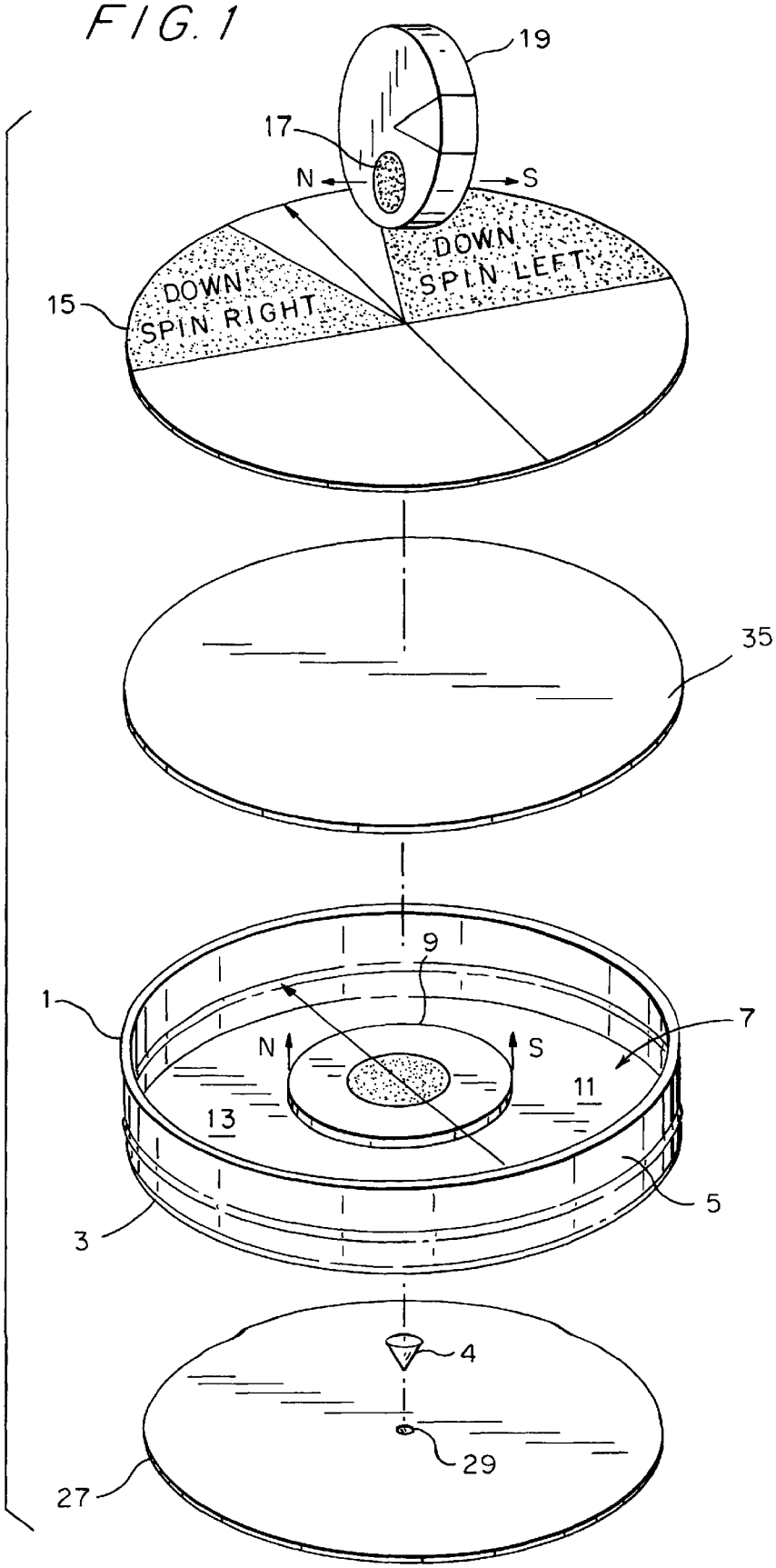
FIG. 1 is an exploded perspective view of the magnetically activated spinning disc with the activator magnet embedded in a coin-shaped device positioned above the center of the disc.
Figure 2:
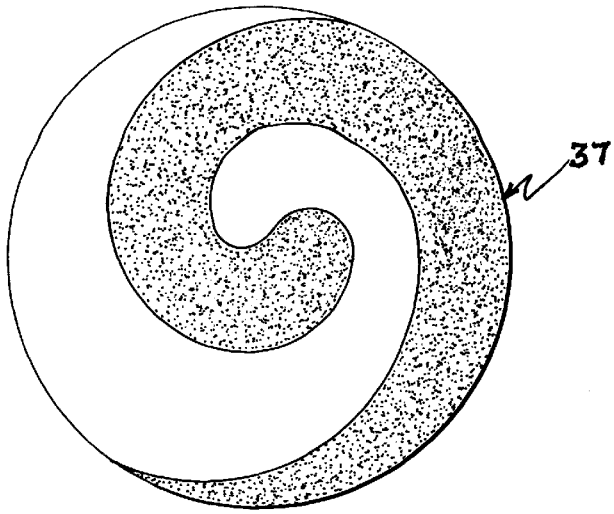
FIG. 2 shows a design template disc with one of many designs that can be utilized to produce a desired visual effect.

The invention will be understood more readily by referring to the drawings in which FIG. 1 is an exploded perspective view showing the magnetically activated spinning disc unit 1 which is typically constructed from injected high-impact polystyrene. The disc comprises a base 3 having a central protrusion 4 projecting downwardly to form a pivot point for rotation, and an upstanding circumferential wall 5 defining a cavity 7 for receiving various templates and design discs, such as the design template disc 37 shown in FIG. 2. The templates are mounted on support disc 35 which provides a flat support surface over a bipolar ring magnet 9, which is mounted on the upper surface of the base 3. The magnetic orientation of the bipolar ring magnet 9 comprises a 180° section 11 of the ring of south polarity and a 180° section 13 of the ring of north polarity.

An alignment template disc 15 is mounted on support disc 35 in cavity 7 to assist the user by marking the positions for application of the external magnetic field of the activator magnet 17, which is mounted in a small disc 19 adapted to be held in the hand of the user. It is to be understood that the small disc 19 may be of any desired shape. For example, as an attraction for children, the disc could be made in the shape of another geometric figure, an animal, or any miniature design that proved to be attractive to younger users.

The disc unit 1 is made to rotate by manipulation of the small disc 19 containing the activator magnet 17, moving it in and out of the magnetic field of the bipolar ring magnet 9 to produce a combined attraction-repulsion effect on the magnetic field of the bipolar magnet 9 and thereby impart a spinning motion to the disc unit 1 around central protrusion 4 which acts as a pivot point. The alignment template disc 15 is useful as a learning tool for the user by marking the points at which the activator magnet 17 can be inserted downwardly into the magnetic field of the bipolar ring magnet 9 to cause the reaction force that produces the spinning motion in the disc unit 1.

The speed of rotation can be varied by increasing or decreasing the cyclical insertion of the activator magnet 17 into the magnetic field of the bipolar ring magnet 9. The disc unit 1 can be made to spin in either direction with a sustainable and controllable speed using the external activator magnet 17. Once the manipulation of the activator magnet 17 has been mastered, the alignment template disc 15 can be removed and replaced with a design template disc 37 that will produce the desired visual effect upon rotation. The design template disc 37 is positioned within the open cavity 7 on top of the support disc 35, and is easily removable when it is desired to replace it with another design disc to produce a different visual effect. The variety of designs adaptable for use in this device is unlimited. The disc unit 1 can be supported for rotation with the addition of a platform disc 27 which may be hand-held as a matter of convenience. The platform disc 27 may have a central indentation 29 to receive the central protrusion 4 on base 3 of the disc unit 1, thereby preventing the disc unit 1 from slipping off platform disc 27 during rotation.

Figure 3:
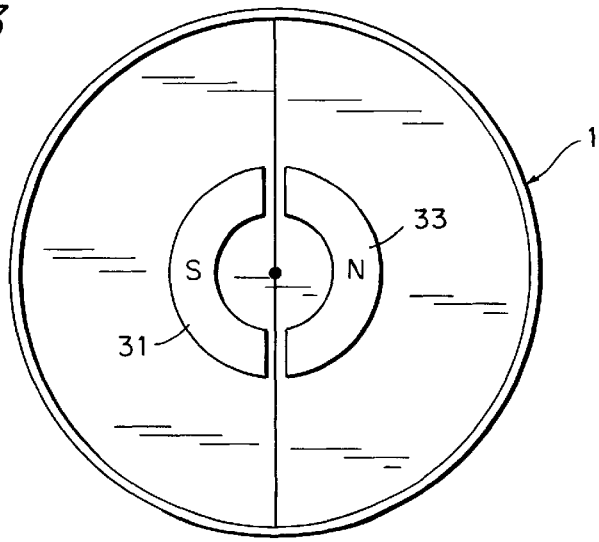
FIG. 3 is a diagrammatic view showing an alternate configuration in which the bipolar ring magnet has been replaced with a pair of semi-circular magnets.
Figure 4:
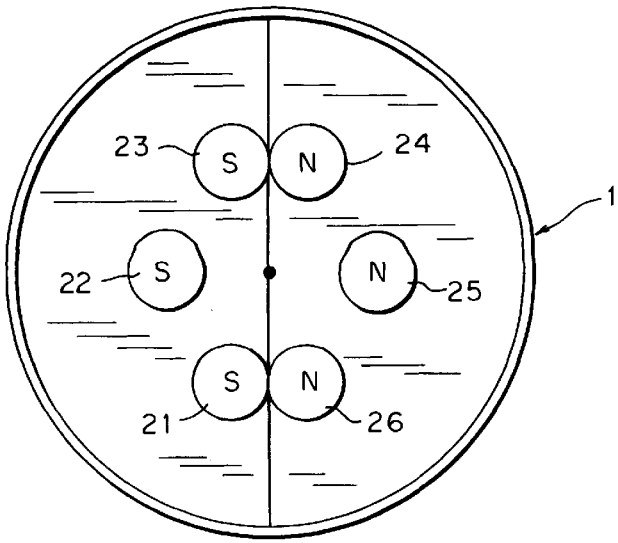
FIG. 4 is a diagrammatic view showing an alternate configuration in which the bipolar ring magnet has been replaced with a plurality of small disc magnets.

Certain specific alternate structures have been found to produce the same effects described if the bipolar ring magnet 9 is replaced with either a split ring magnet comprising a pair of semi-circular sections 31 (south polarity) and 33 (north polarity), such as shown in FIG. 3, or a series of small disc magnets 21–26 oriented as shown diagrammatically in FIG. 4.

In FIG. 4, three small disc magnets with their south magnetic poles facing upwardly are positioned on a 180° section 31 of the disc, and three small disc magnets with their north magnetic poles facing upwardly are positioned on the remaining 180° section 33. The action of the activator magnet 17 in this configuration is the same as with the bipolar ring magnet 9 and the split ring magnet sections 31 and 33.

This invention incorporates in a single device numerous highly fascinating features which have long intrigued people of all ages, i.e., invisible magnetic forces, rotational and spinning actions, captivating visual effects, creative arts, etc. The disc is a hands-on device enabling the operator to clearly feel and experience the interacting magnetic fields pulling and pushing as it spins. The degree to which the synchronization of movement between the activator magnet and the disc's rotating magnetic fields is mastered determines how fast the disc will spin. This makes the invention suitable for spinning speed competitions between individuals or against measurement devices. The strong attracting and repelling sensations when making the disc spin has a somewhat therapeutic reaction making this invention very useful as a stress and tension reliever and for hand-eye coordination development.

While there are many kinds of tops which spin, the present invention enables initiation of the spinning action without physically touching the device simply by using its powerful magnetic forces. The invention also allows for precise directional and spinning speed control through proper manipulation of the activator magnet. This feature becomes important when a particular spiral design is most effective at a particular spinning speed, or when the design disc must be rotated in a specific direction. Further, most tops have a protruding arm or other gripping device rising up on top which impedes a full view or restricts placing visual designs, devices or other apparatus in the center. This invention allows for a wide variety of devices and designs to be set and fully displayed in the center of the disc without obstruction.

It will be obvious to those skilled in the art that various modifications may be made to the embodiments described herein without departing from the spirit of the invention, and the invention includes all such modifications.

What is claimed is:

1. A magnetically-activated device for producing a spinning motion comprising a disc member;

a central protrusion in the underside of said disc member providing a pivot point for rotation;

bipolar magnetic means located on the upper surface of the disc member and positioned concentrically with respect to the central protrusion;

a second disc member having a design imprinted thereon, said second disc member being positioned concentrically over said bipolar means; and a hand-held activator magnet for synchronized movement with respect to the bipolar magnetic means;

whereby controlled movements of the hand-held activator magnet cause the magnetic field of the activator magnet to interact with the bipolar magnetic means to produce a spinning motion around the central protrusion in the disc member thereby producing a desired visual effect when viewed from the top as the combination rotates in response to the magnetic field of the activator magnet.

2. A magnetically-activated device for producing a spinning motion comprising a first disc member having a flat bottom and an upstanding circumferential wall;

a central protrusion in the underside of said first disc member providing a pivot point for rotation;

bipolar magnetic means located on the upper surface of said first disc member and positioned concentrically with respect to the central protrusion;

a second disc member having a design imprinted on the top surface to produce desired visual effects during rotation, said second disc member being positioned concentrically over said bipolar magnetic means within said circumferential wall;

a hand-held activator magnet for synchronized movement with respect to the bipolar magnetic means;

whereby the hand-held activator magnet can be positioned movably over said first disc member to produce a rotating motion around the central protrusion and create a desired visual effect when the design on the second disc member is viewed from the top during rotation.

3. The combination according to claim 2 wherein said bipolar magnetic means comprises a ring magnet.

4. The combination according to claim 2 wherein said bipolar magnetic means comprises a split ring magnet having 180° sections of opposite polarity.

5. The combination according to claim 2 wherein said bipolar means comprises a plurality of magnetic discs in groups of like polarities positioned concentrically with respect to said central protrusion.

6. The combination according to claim 2 comprising a flat member adapted to be hand-held to provide a portable surface on which the magnetically-activated device can be positioned to demonstrate the spinning action.

7. A magnetically-activated device for producing a spinning motion comprising a first disc member having a flat bottom and an upstanding circumferential wall;

a central protrusion in the underside of said first disc member providing a pivot point for rotation;

a bipolar ring magnet located on the upper surface of said first disc member and positioned concentrically with respect to the central protrusion;

a second disc member having a design imprinted on the top surface to produce desired visual effects during rotation, said second disc member being positioned concentrically over said bipolar ring magnet within said circumferential wall;

a hand-held activator magnet for synchronized movement with respect to the bipolar ring magnet;

a flat member adapted to be hand-held to provide a portable surface on which the central protrusion in the first disc member can be positioned to demonstrate the rotating motion of the magnetically-activated device;

whereby the hand-held activator magnet can be positioned movably over said first disc member to produce a rotating motion around the central protrusion and create a desired visual effect when the design on the second disc member is viewed from the top during rotation.

* * * * *